US008146916B2

(12) United States Patent
Inui et al.

(10) Patent No.: US 8,146,916 B2
(45) Date of Patent: Apr. 3, 2012

(54) SHEET CONVEYING APPARATUS AND IMAGE FORMING APPARATUS

(75) Inventors: Fumiki Inui, Mishima (JP); Kazunari Nishimoto, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/499,333

(22) Filed: Jul. 8, 2009

(65) Prior Publication Data

US 2009/0267292 A1 Oct. 29, 2009

Related U.S. Application Data

(62) Division of application No. 11/682,389, filed on Mar. 6, 2007, now Pat. No. 7,571,908.

(30) Foreign Application Priority Data

Mar. 27, 2006 (JP) ..... 2006-086689

(51) Int. Cl.
*B65H 9/16* (2006.01)

(52) U.S. Cl. ..... 271/251; 271/248

(58) Field of Classification Search ..... 271/248–253
See application file for complete search history.

(56) References Cited

U.S. PATENT DOCUMENTS

| | | | | |
|---|---|---|---|---|
| 5,162,857 | A | 11/1992 | Higeta et al. | 399/401 |
| 5,253,862 | A | 10/1993 | Acquaviva et al. | 271/251 |
| 5,284,333 | A * | 2/1994 | Ishikawa | 271/22 |
| 5,316,288 | A | 5/1994 | Fish et al. | 271/250 |
| 5,507,482 | A * | 4/1996 | Tenpaku et al. | 271/251 |
| 5,657,983 | A | 8/1997 | Fisk | 271/251 |
| 6,273,418 | B1 | 8/2001 | Fujikura et al. | 271/228 |
| 6,324,377 | B2 | 11/2001 | Ando et al. | 399/395 |
| 6,356,735 | B1 * | 3/2002 | Hozumi | 399/395 |
| 7,097,776 | B2 | 8/2006 | Govinda Raju | 216/11 |
| 7,306,221 | B2 | 12/2007 | Agata | 271/251 |
| 7,540,496 | B2 * | 6/2009 | Fukushima | 271/253 |
| 2004/0188929 | A1 | 9/2004 | Tada et al. | 271/248 |
| 2006/0022399 | A1 * | 2/2006 | Fukushima | 271/226 |
| 2008/0258378 | A1 | 10/2008 | Inui | 271/226 |

FOREIGN PATENT DOCUMENTS

JP 2000-233850 8/2000

* cited by examiner

*Primary Examiner* — Gerald McClain
*Assistant Examiner* — Thomas Morrison
(74) *Attorney, Agent, or Firm* — Fitzpatrick, Cella, Harper & Scinto

(57) ABSTRACT

Positioning in the width direction of a sheet is performed by a skew correcting unit which is provided on a re-conveying path for reversing the sheet and conveying it again to an image forming unit and which has a reference surface that is come into contact with a side edge of the sheet and a plurality of diagonal feed units which obliquely convey the sheet so as to be come into contact with the reference surface. The pressures in nip portions of the other diagonal feed units excluding one of the plural diagonal feed units are reduced or cancelled by a reducing/cancelling unit according to a length in the sheet conveying direction of the sheet which is conveyed.

7 Claims, 9 Drawing Sheets

FIG. 10A
CONVENTIONAL
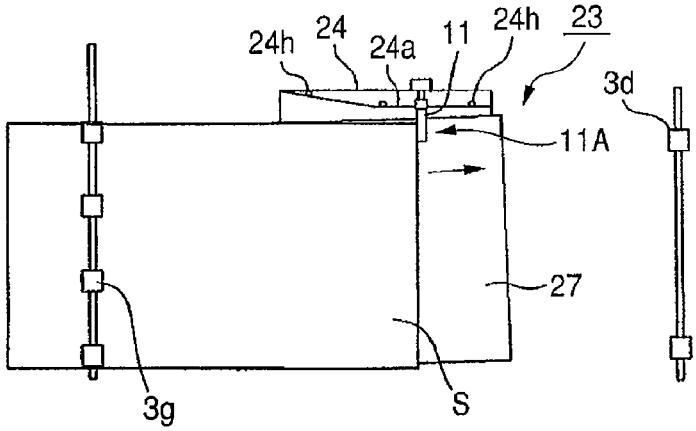
FIG. 10B
CONVENTIONAL
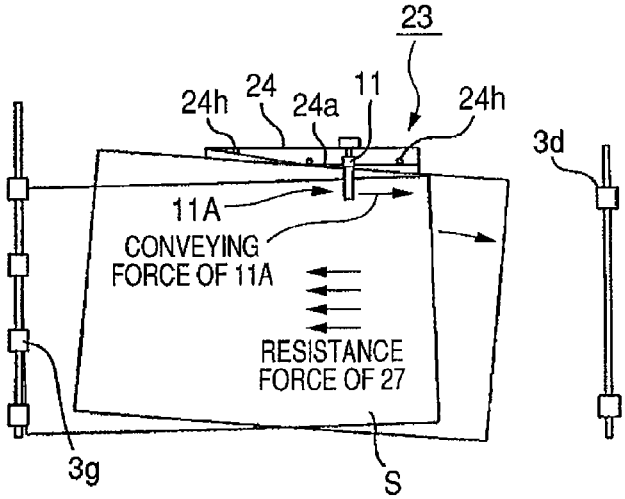
FIG. 10C
CONVENTIONAL
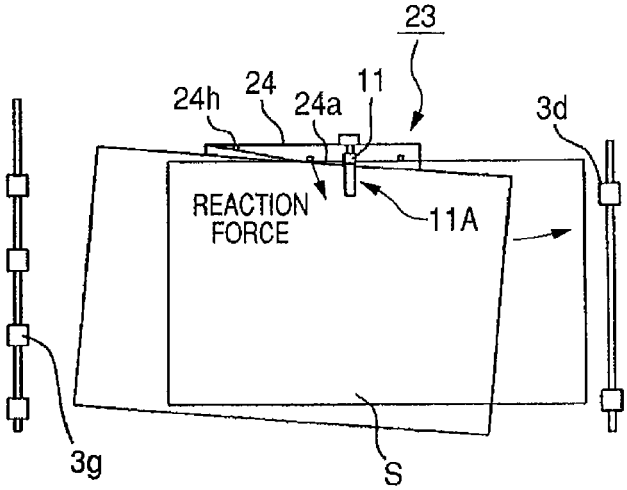

CONVENTIONAL
FIG. 11
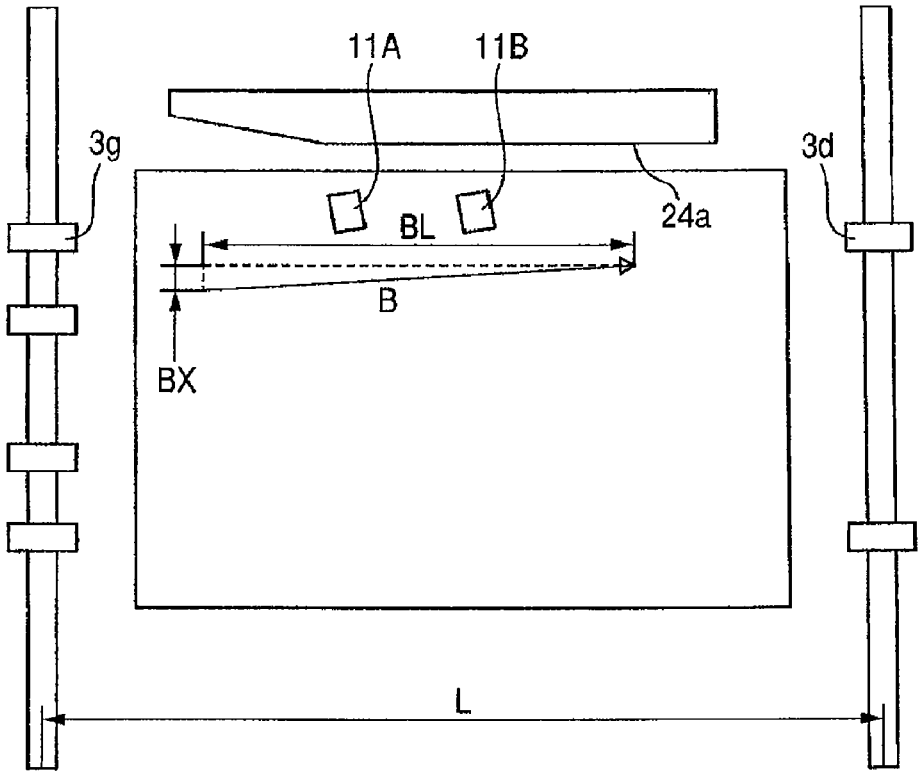
CONVENTIONAL
FIG. 12
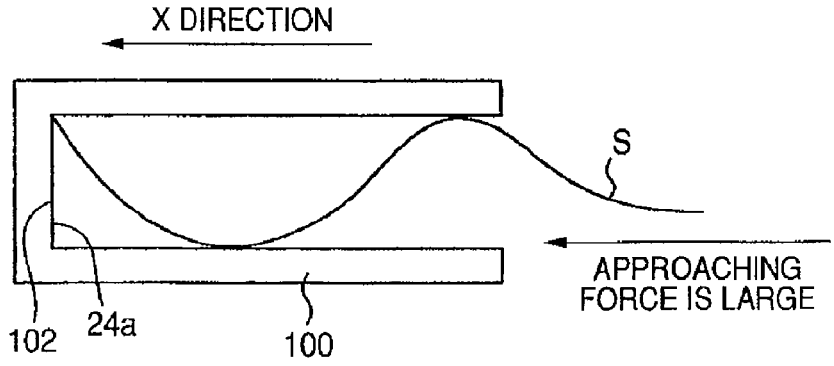

SHEET CONVEYING APPARATUS AND IMAGE FORMING APPARATUS

This is a divisional of U.S. patent application Ser. No. 11/682,389, filed Mar. 6, 2007, allowed May 8, 2009.

BACKGROUND OF THE INVENTION

1. Field of the Invention

The present invention relates to a sheet conveying apparatus and an image forming apparatus and, more particularly, to positioning in the width direction of a sheet which is performed when the sheet with an image formed on one surface is reversed and is conveyed again to an image forming unit and an image is formed onto a reverse surface of the sheet.

2. Description of the Related Art

Hitherto, among image forming apparatuses such as an electrophotographic printer and the like, there is an apparatus constructed in such a manner that a sheet with an image formed on one surface is reversed and is conveyed again to an image forming unit, thereby forming an image onto a reverse surface of the sheet. Such an image forming apparatus has a sheet conveying apparatus for reversing the sheet with the image formed on one surface and conveying the sheet again to the image forming unit.

In such a conventional sheet conveying apparatus, in the case of conveying the sheet again to the image forming unit, there is a case where the sheet is obliquely moved during the conveyance and when the image is formed onto the reverse surface, the image is deviated from the sheet. This is because in the case of forming the image onto the second surface (reverse surface), since a conveying path to a position until the image is formed onto the sheet is longer than that for the first surface, the sheet is slightly deviated during the conveyance due to differences among eccentricity values and pressing forces of various rollers, a difference between resistance values of the conveying surfaces, or the like.

To prevent such a sheet deviation, therefore, it is necessary to adjust a position of the sheet so that the position of the image and that of the sheet coincide for a time interval until the image is formed onto the second surface after the image was formed onto the first surface. As such a sheet position adjusting method, for example, there is such a method whereby a reference surface is arranged in one end portion of a re-conveying path for conveying the sheet again to the image forming unit and the sheet is conveyed while pressing the sheet onto the reference surface, thereby performing the positioning in the width direction of the sheet (referred to as a lateral registration correction). For example, there is a technique disclosed in Japanese Patent Application Laid-Open No. 2000-233850.

FIGS. 10A, 10B, and 10C are top views illustrating a construction of the re-conveying path of the conventional sheet conveying apparatus having a lateral registration correcting portion for making the lateral registration correction of the sheet by the reference surface.

A lateral registration correcting portion 23 has: a reference guide 24 including a reference surface 24*a*; an diagonal feed roller pair 11A constructed by a diagonal feed roller 11 and a diagonal feed roller (not shown); and a conveyance lower guide 27. The diagonal feed rollers are arranged so as to face the reference surface 24*a* and have an inclination angle of about 7°. Each diagonal feed roller has a drum shape. Since the reference surface 24*a* is scraped by the sheet edge portion upon sheet passage, it is enhanced by arranging a plurality of reference pins 24*h* made of a metal.

The positioning operation of the lateral registration correcting portion 23 with such a construction will now be described.

As illustrated in FIG. 10A, a sheet S having the image formed on one surface is conveyed toward the lateral registration correcting portion 23 from conveying rollers 3*g* provided on the upstream of the lateral registration correcting portion 23. When the sheet S reaches the diagonal feed roller pair 11A soon, the sheet S is subsequently sandwiched between the diagonal feed roller pair 11A and conveyed. The sheet S is conveyed while being pulled toward the reference surface 24*a* side by the diagonal feed roller pair 11A.

Subsequently, when a rear edge of the sheet S goes away from the conveying rollers 3*g*, the sheet S receives a resistance of the conveyance lower guide 27 and rotates so that the sheet rear edge approaches the reference surface 24*a* side as illustrated in FIG. 10B. The sheet S is come into contact with the reference pins 24*h* by the rotation. The sheet rotates by its reaction force so that a sheet front edge approaches the reference surface 24*a* side.

Thus, the sheet S is aligned to a position along the reference surface 24*a* as illustrated in FIG. 10C. After that, the sheet S which has been positioned by the lateral registration correcting portion 23 as mentioned above is conveyed again to the image forming unit (not shown) through intermediate rollers 3*d*.

As mentioned above, in the lateral registration correcting portion 23, the sheet S is rotated by the resistance of the diagonal feed roller pair 11A and the conveyance lower guide 27 and, thereafter, reversely rotated so as to be conveyed along the reference surface 24*a* while using the reference pins 24*h* as pivot points. According to such a lateral registration correcting method, since a conveyance distance to a position until the sheet is conveyed along the reference surface 24*a* after it went away from the conveying rollers 3*g* can be short, positioning (skew correction) efficiency is high.

However, in such conventional sheet conveying apparatus and image forming apparatus, since only one diagonal feed roller pair 11A has been provided, the position of the diagonal feed roller pair 11A in the sheet conveying direction has to be located within a range of the minimum length of the sheet to be conveyed. Therefore, it is necessary to set a distance between the diagonal feed roller pair 11A and the conveying roller 3*g* and a distance between the diagonal feed roller pair 11A and the intermediate roller 3*d* to be shorter than the minimum length of the sheet to be conveyed.

However, if the position of the diagonal feed roller pair 11A is set as mentioned above, the sheet whose length in the sheet conveying direction is shorter than the distance between the diagonal feed roller pair 11A and the conveying roller 3*g* cannot be conveyed. Therefore, in the case of conveying the sheets of many sizes including such a short sheet, it is necessary to provide a plurality of roller pairs into the re-conveying path.

For example, assuming that the minimum length of the sheet to be conveyed is set to the A5 size and the minimum feed size length is set to 210 mm, when a conveying path length between the conveying roller 3*g* and the intermediate roller 3*d* exceeds about 400 mm, it is necessary to provide at least two or more roller pairs into the re-conveying path.

However, for example, if two diagonal feed roller pairs 11A and 11B are provided in the re-conveying path as illustrated in FIG. 11, in the case where the sheet S is sandwiched between those two diagonal feed roller pairs 11A and 11B, the rotation of the sheet S that is caused by the conveyance resistance cannot be executed when the rear edge goes away from the conveying roller 3*g*. In other words, if the two or more diagonal feed roller pairs are provided as mentioned above, the foregoing lateral registration correction by the one diagonal feed roller pair 11A does not function.

Therefore, when the two or more diagonal feed roller pairs are provided, by moving the sheet S in parallel in the direction shown by an arrow B by the diagonal feed roller pairs 11A and 11B, the sheet S is come into contact with the reference surface 24*a*, thereby performing the lateral registration correction of the sheet S.

When the length of sheet S is long, since it is necessary to correct the skew before the front edge of the sheet reaches the intermediate roller 3*d* after it went away from the conveying roller 3*g*, it is necessary to increase nip pressures of the diagonal feed roller pairs 11A and 11B and increase a diagonal feed force adapted to make the sheet S approach in the direction of the arrow B. However, if the diagonal feed force is increased as mentioned above, for example, when the sheet S is thin (rigidity is small), since an approaching force in the direction shown by an arrow X illustrated in FIG. 12 is too large, the sheet S is come into contact with the reference surface 24*a* and bent. Thus, the sheet S is conveyed in the state where the position in the width direction for the reference surface 24*a* has been deviated. The lateral registration correction cannot be properly performed.

Since the approaching force in the width direction is too large, if the apparatus is used for a long time, the reference surface 24*a* is scratched by the sheet edge portion. Further, there is also a situation that the scratch on the reference surface 24*a* becomes a conveyance resistance to the sheet edge portion and a jam is caused by such a scratch.

In the case where the diagonal feed force is not increased in consideration of the bending of the thin sheet in the width direction and the scratch formed on the reference surface 24*a*, the sheet S has to be made to approach slightly by a vector for allowing the sheet to approach in the arrow B direction. Thus, a conveyance distance BL is necessary to allow the sheet to approach by a deviation amount BX of the sheet S in the width direction illustrated in FIG. 11.

That is, in the case of moving the sheet S in parallel by a plurality of diagonal feed roller pairs, there is a case where the lateral registration correction cannot be properly made in dependence on the rigidity of the sheet S. The conveyance distance necessary to make the sheet S approach becomes long in dependence on the length of sheet S.

If the size of sheet to be used is assumed to be, for example, the size in a range from A5 to the letter (legal) size, when the sheet is conveyed in a center reference manner, the sheet is conveyed in the state where it is away from the reference surface 24*a* by up to 34 mm (the letter width—A5) in the width direction. Even in such a case, the sheet S has to be made to approach the reference surface 24*a*.

Also in such a case, since a skew correction amount is too large, for example, if the diagonal feed force for allowing the sheet S to approach in the arrow B direction is increased, the lateral registration correction cannot be properly made. If the sheet S of a long sheet feeding size, for example, the sheet S of a legal size is conveyed in the state where it is deviated in such a direction as to be away from the reference surface 24*a*, the sheet reaches the intermediate roller 3*d* before the lateral registration correction is finished.

SUMMARY OF THE INVENTION

The invention is, therefore, made in consideration of such a present situation and it is an object of the invention to provide a sheet conveying apparatus and an image forming apparatus, in which positioning of a sheet in the width direction can be certainly performed irrespective of a rigidity and a size of the sheet.

According to the invention, there is provided an image forming apparatus in which a sheet with an image formed on one surface by an image forming unit is reversed and conveyed again to the image forming unit, comprising: a re-conveying path which reverses the sheet having the image formed on one surface by the image forming unit and guides the sheet again to the image forming unit; a skew correcting unit provided on the re-conveying path, having a reference surface to which a side edge of the sheet abuts, and a plurality of diagonal feed units which diagonally convey the sheet, and abut the sheet to the reference surface; and a reducing/cancelling unit which reduces or cancels pressures in nip portions of the other diagonal feed units excluding one of the plurality of diagonal feed units, wherein the pressures of the nip portions of the diagonal feed units are reduced or cancelled by the reducing/cancelling unit according to a length in a sheet conveying direction of the sheet which is conveyed.

Further features of the present invention will become apparent from the following description of exemplary embodiments with reference to the attached drawings.

BRIEF DESCRIPTION OF THE DRAWINGS

FIGS. 10A, 10B, and 10C are plan views illustrating a construction of a re-conveying path of a conventional sheet conveying apparatus.

FIG. 11 is a plan view illustrating a construction of the re-conveying path on which two diagonal feed roller pairs are arranged according to the conventional sheet conveying apparatus.

FIG. 12 is a diagram illustrating the state where a sheet has been made to approach a reference surface by a large approaching force according to the conventional sheet conveying apparatus.

DESCRIPTION OF THE EMBODIMENTS

An exemplary embodiment for embodying the invention will be described in detail hereinbelow with reference to the drawings.

Figure 1:
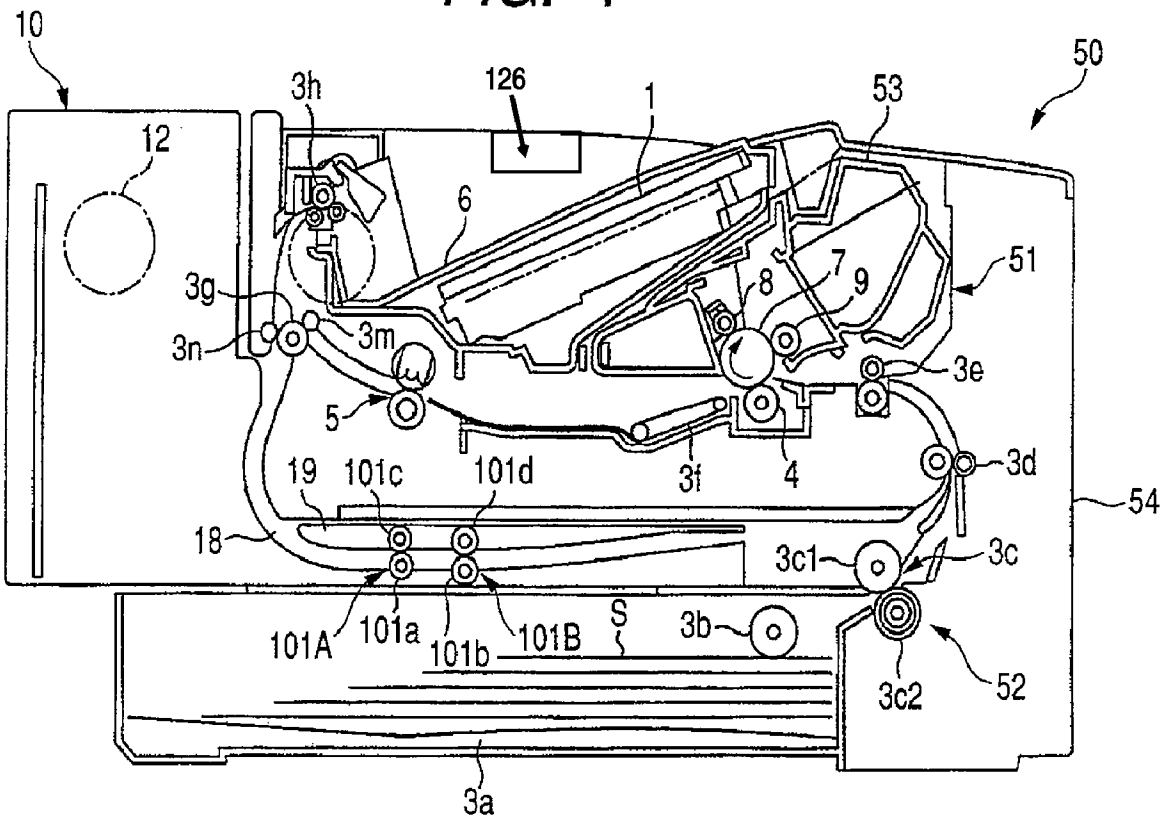
FIG. 1 is a diagram illustrating a schematic construction of a laser beam printer as an example of an image forming apparatus having a sheet conveying apparatus according to an embodiment of the invention.

FIG. 1 is a diagram illustrating a schematic construction of a laser beam printer as an example of an image forming apparatus having a sheet conveying apparatus according to the embodiment of the invention.

In FIG. 1, a laser beam printer 50 which forms an image by an electrophotographic system has: an image forming unit 51 for executing the image creation; a feeding unit 52 for separating and feeding the sheets S one by one to the image forming unit 51; and the like. In order to enable the images to be formed onto both surfaces of the sheet S, the laser beam printer 50 has a duplex unit 10, as an option, for feeding the sheet S again to the image forming unit 51 in such a manner that after the image was formed onto one surface, the image is formed onto the reverse surface.

The image forming unit 51 has a process cartridge 53, a transfer roller 4, and the like. The feeding unit 52 has: a sheet feeding cassette 3*a* for stacking the sheets S; a pickup roller 3*b*; and a separating roller pair 3*c* including a feed roller 3*c*1 and a retard roller 3*c*2. The process cartridge 53 integratedly has: a photosensitive drum 7; a charging roller 8 for uniformly charging the surface of the photosensitive drum; a developing unit 9 for developing an electrostatic latent image formed on the photosensitive drum; and the like. The process cartridge 53 is detachable for a laser beam printer main body (hereinbelow, referred to as an apparatus main body) 54.

The duplex unit 10 has a re-conveying path 18; and a lateral registration correcting unit, which will be described hereinafter. The lateral registration correcting unit has: diagonal feed roller pairs 101A and 101B constructed by diagonal feed rollers 101*a*, 101*b*, and the like; and the like. In FIG. 1, a laser scanner unit 1, a fixing unit 5, and a discharge tray 6 are provided.

The image forming operation of the laser beam printer 50 constructed as mentioned above will now be described.

Image information is transmitted from a personal computer (hereinbelow, also abbreviated to PC) or the like (not shown) to a control unit (not shown). The image information is image-forming processed in the control unit. After that, when a print signal is generated from the control unit, the photosensitive drum 7 rotates in the direction shown by an arrow and is uniformly charged to a predetermined polarity and a predetermined electric potential by the charging roller 8. A laser beam is irradiated from the laser scanner unit 1 based on the image information onto the photosensitive drum 7 whose surface has been charged as mentioned above. Thus, the electrostatic latent image is formed on the photosensitive drum 7. Subsequently, the electrostatic latent image is developed by the developing unit 9 and visualized as a toner image.

In parallel with the toner image forming operation as mentioned above, the sheets S stacked and enclosed in the sheet feeding cassette 3*a* are fed out one by one by the pickup roller 3*b* and, thereafter, separated and conveyed by the separating roller pair 3*c*. Further, after that, by the intermediate roller 3*d* and a conveying roller pair 3*e*, the sheet is conveyed to a transfer unit constructed by the photosensitive drum 7 and the transfer roller 4.

In this instance, a front edge of the sheet S is detected by a registration sensor (not shown) provided on the upstream of the transfer unit. The control unit synchronizes the front edge position of the sheet S with light emission timing of the laser scanner unit 1 based on a detection signal of the registration sensor. Thus, the toner image formed on the photosensitive drum can be transferred to a predetermined position on the sheet S.

The sheet S onto which the toner image has been transferred as mentioned above is sent to the fixing unit 5 along a conveying belt 3*f*. When the sheet passes through the fixing unit 5, it is heated and pressed, so that the toner image is semipermanently fixed.

In the case of executing simplex printing, the sheet S which has passed through the fixing unit 5 is sent to a nip portion constructed by the conveying roller 3*g* which can be forwardly and reversely rotated and a first roller 3*m*. After that, the sheet S is ejected to the discharge tray 6 by the forward rotation of a discharge roller 3*h* (of the conveying roller 3*g*) which can be forwardly and reversely rotated.

In the case of executing duplex printing, the discharge roller 3*h* conveys the sheet S toward the discharge tray 6 by the forward rotation. Subsequently, after the sheet rear edge went away from the conveying roller 3*g*, the sheet S is reversely rotated. When the rear edge of the sheet S goes away from the conveying roller 3*g*, the rear edge moves toward a second roller 3*n* side by its rigidity. When the discharge roller 3*h* is further reversely rotated in this state, the rear edge of the sheet S enters the nip portion constructed by the conveying roller 3*g* and the second roller 3*n* and is sandwiched between the conveying roller 3*g* and the second roller 3*n*.

When the sheet S is sandwiched between the conveying roller 3*g* and the second roller 3*n* as mentioned above, the conveying roller 3*g* has reversely been rotated. Thus, the sheet S passes through the re-conveying path 18 of the duplex unit 10 and the skew is corrected by the diagonal feed roller pairs 101A and 101B. Further, after that, the sheet S is sent again to the image forming unit 51 through the intermediate roller 3*d*. The image of the second surface is formed by the image forming unit 51 and, thereafter, the sheet is stacked onto the discharge tray 6 by the discharge roller 3*h*.

Figure 2:
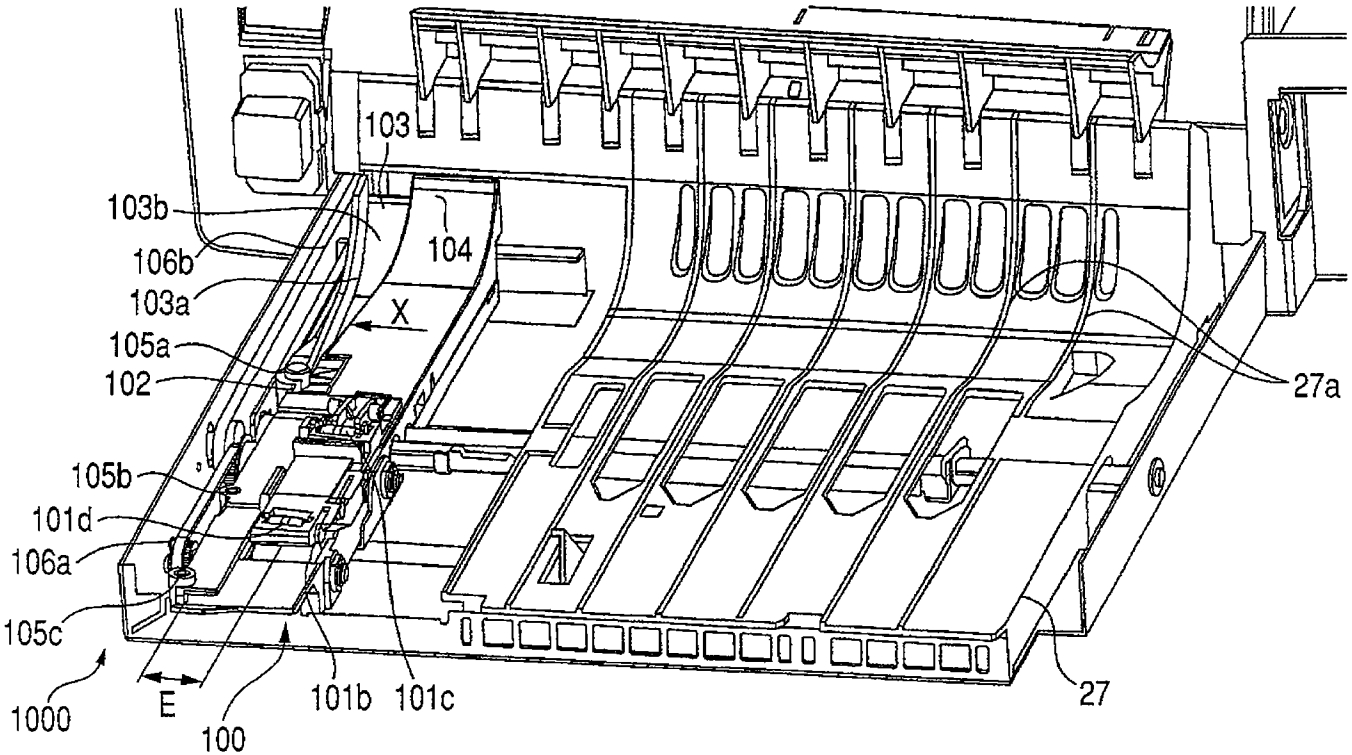
FIG. 2 is a perspective view for describing a construction of a duplex unit as a sheet conveying apparatus.
Figure 3:
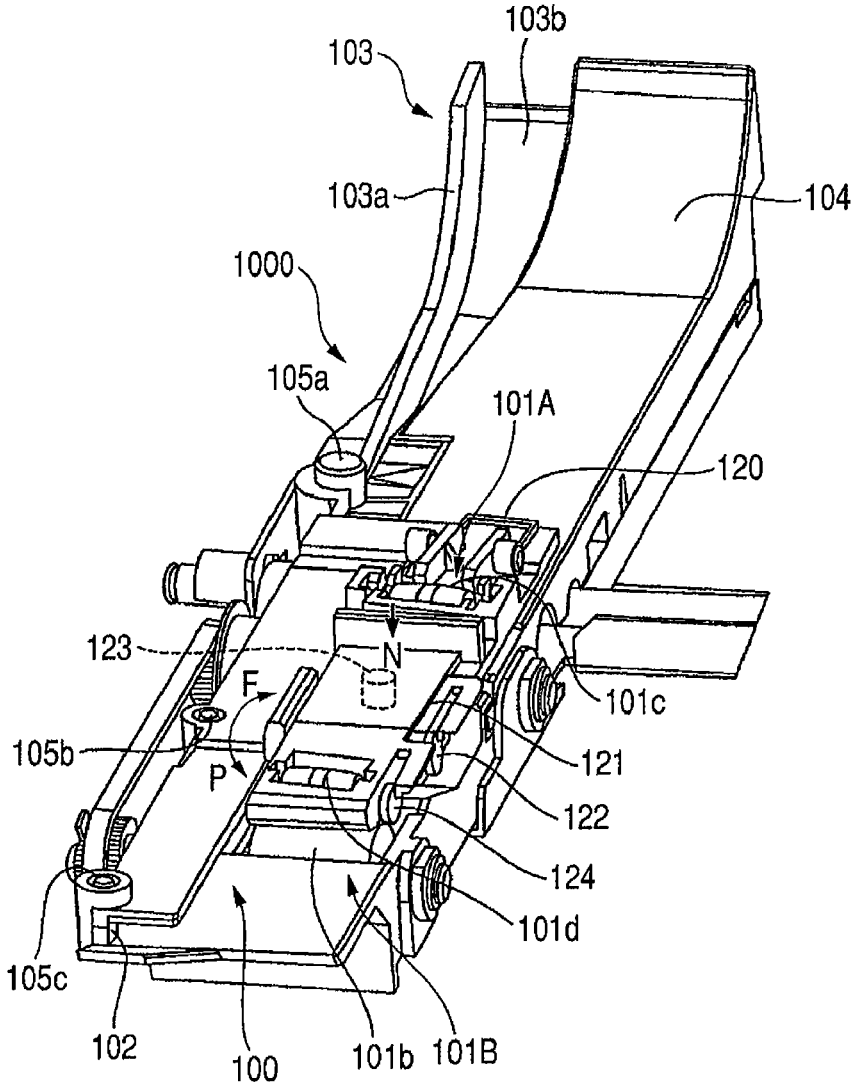
FIG. 3 is a perspective view for describing a lateral registration correcting unit provided for the duplex unit.

As illustrated in FIGS. 2 and 3, the duplex unit 10 as a sheet conveying apparatus has a lateral registration correcting unit 1000 as a skew correcting unit having: the diagonal feed roller pairs 101A and 101B as a diagonal feed unit; a reference member 100 as a holding member for holding the diagonal feed roller pairs 101A and 101B; and the like.

A reference surface 102 is provided for one edge portion in the width direction of the reference member 100. When the sheet passes through the re-conveying path 18 (refer to FIG. 1), the sheet is pressed to the reference surface 102 by the diagonal feed roller pairs 101A and 101B, thereby performing the positioning in the width direction of the sheet.

Figure 4:
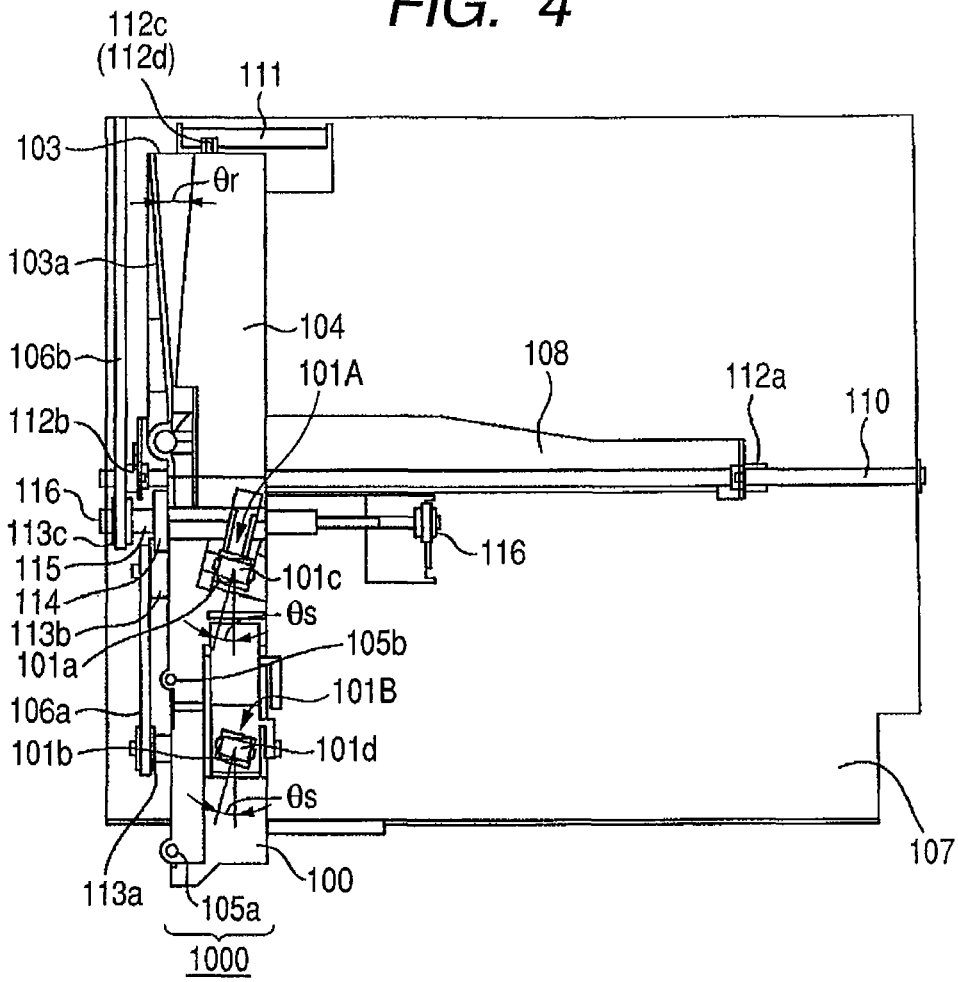
FIG. 4 is a top view of the duplex unit.

Since the reference surface 102 extending in the sheet conveying direction is scraped by the pressed sheet, a plurality of reference pins 105*a* to 105*c* made of a metal are inserted with a pressure into the reference surface 102, thereby enhancing a rigidity of the reference surface. In FIGS. 2 and 3, an upper portion of the passing sheet surface on the upstream of the reference pin 105*a* is cut away. The diagonal feed roller pair 101A has diagonal feed rollers 101*a* and 101*b* (refer to FIG. 1). The diagonal feed roller pair 101B has diagonal feed rollers 101*b* and diagonal feed rotation member 101*d* (refer to FIG. 1). The diagonal feed rollers 101*a* and 101*b* are arranged in the sheet width direction which perpendicularly crosses the conveying direction of the sheet and supported to axes to which the driving is propagated. The diagonal feed rotation member 101*c* and 101*d* are obliquely in pressure-contact with the diagonal feed rollers 101*a* and 101*b* at an oblique conveyance angle θs as illustrated in FIG. 4.

As illustrated in FIG. 3, the diagonal feed rotation member 101*c* is always in pressure-contact with the diagonal feed roller 101*a* at a predetermined pressure within a range from 0.5 to 5 N by a coil spring 120. The diagonal feed rotation member 101*d* is rotatably held by an axis 124 provided for a diagonal feed roller holder 121 as a roller holding unit held to the reference member 100 by a swing axis 122 so that it can swing freely.

A compression spring 123 is provided on a swing edge side opposite to the diagonal feed rotation member 101*d* of the diagonal feed roller holder 121. Since the diagonal feed rotation member 101*d* is urged in the direction of an arrow P by the compression spring 123, the diagonal feed rotation member 101*d* can be come into pressure-contact with the diagonal feed roller 101*b* at the predetermined pressure within the range from 0.5 to 5 N.

The diagonal feed roller pairs 101A and 101B which have been constructed and held to the reference member 100 as mentioned above allows the sheet to approach the reference surface 102. That is, the sheet conveyed by the conveying rollers 3*g* as a first conveying unit provided on the upstream side of the lateral registration correcting unit 1000 is made to approach the reference surface 102. Further, after that, the sheet is conveyed along the reference surface 102. Thus, the position of the sheet S in width direction is matched with a reference line formed by coupling the reference pins 105*a* to 105*c*. In this state, the sheet is conveyed to the intermediate roller 3*d* as a second conveying unit provided on the downstream side of the lateral registration correcting unit 1000.

In FIG. 4, the driving of a sheet re-feeding motor (refer to FIG. 1) is propagated to each axis of the diagonal feed roller pairs 101A and 101B through timing belts 106*a* and 106*b* and pulleys 113*a* to 113*c*.

A sheet introducing portion 103 and a slope 104 are provided on the upstream side of the reference member 100 as illustrated in FIGS. 2, 3 and 4.

A side edge 103*a* of the sheet introducing portion 103 has a rake angle in such a direction as to approach from the direction away from the center in the sheet conveying direction. Thus, if the sheet was conveyed in the state where it is deviated in the X direction in the width direction illustrated in FIG. 2, the sheet is conveyed while the sheet edge portion is raked in the width direction—the X direction by the rake angle of the side edge 103*a* of the sheet introducing portion.

In FIG. 2, the conveyance lower guide 27 is arranged in parallel with the reference member 100 and constructs a lower surface (bottom surface) of the re-conveying path 18. A conveyance lower surface 27*a* of the conveyance lower guide 27 is almost the same surface as a conveyance path lower surface 103*b* of the sheet introducing portion 103.

The slope 104 constructs a sheet conveying surface of the reference member 100. As illustrated in FIG. 4, the side edge side of the sheet introducing portion of the slope 104 has a gradient θr for the sheet introducing portion side edge 103*a*. That is, the side edge side has a gradient which approaches the downstream from the upstream for the sheet introducing portion side edge 103*a*.

The slope 104 is projected for the conveyance path lower surface 103*b* of the sheet introducing portion 103 and the conveyance lower surface 27*a* of the conveyance lower guide 27. Thus, even if the sheet was conveyed to the duplex unit 10 in the state where it is deviated in the X direction, the sheet is raked in the width direction and can be made to efficiently approach the reference line formed by coupling the reference pins 105*a* to 105*c* by the slope 104 and the sheet introducing portion side edge 103*a*.

In FIG. 4, a bottom plate 107 as a structure of the duplex unit 10 is provided. A main axis 110 made of SUS, SUM, or the like is provided for the bottom plate 107 in the width direction. A plate 108 is attached to a bottom surface of the lateral registration correcting unit 1000. The plate 108 has bearings 112*a* and 112*b* adapted to be fitted to the main axis 110.

The lateral registration correcting unit 1000 is attached to the bottom plate 107 through the bearings 112*a* and 112*b* provided for the plate 108 and the main axis 110 so as to be movable in the width direction.

A rail portion 111 formed by being bent into a Z-shape from the bottom plate 107 is provided on the upstream side in the conveying direction of the bottom plate 107 in parallel with the main axis 110. Rotation stop members 112*c* and 112*d* are provided for the reference member 100. The rotation stop members 112*c* and 112*d* are come into engagement with the rail portion 111, thereby restricting the rotation of the reference member 100 (lateral registration correcting unit 1000) around the main axis 110 as a fulcrum.

Figure 5:
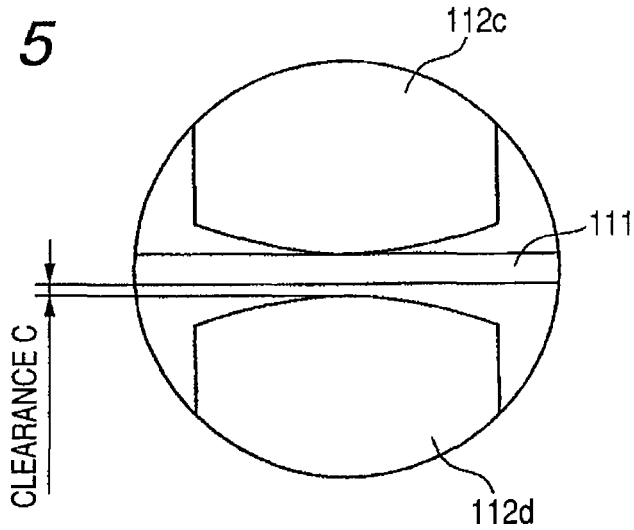
FIG. 5 is an enlarged diagram of a rail portion provided for the duplex unit.

As illustrated in FIG. 5, in each of the rotation stop members 112*c* and 112*d*, a contact surface with the rail portion 111 has an arc shape. There is a clearance C of about 0.2 mm between the rotation stop member 112*d* and the rail portion 111. By providing such a clearance C, even if a deviation of a parallel degree between the main axis 110 and the rail portion 111, a warp of the plate 108, or a deviation on the tolerance occurs, the rotation stop members 112*c* and 112*d* are come into engagement with the rail portion 111 in a point-contact manner without fluctuating. Thus, a slide resistance upon movement in the width direction of the lateral registration correcting unit 1000 can be reduced.

Figure 6:
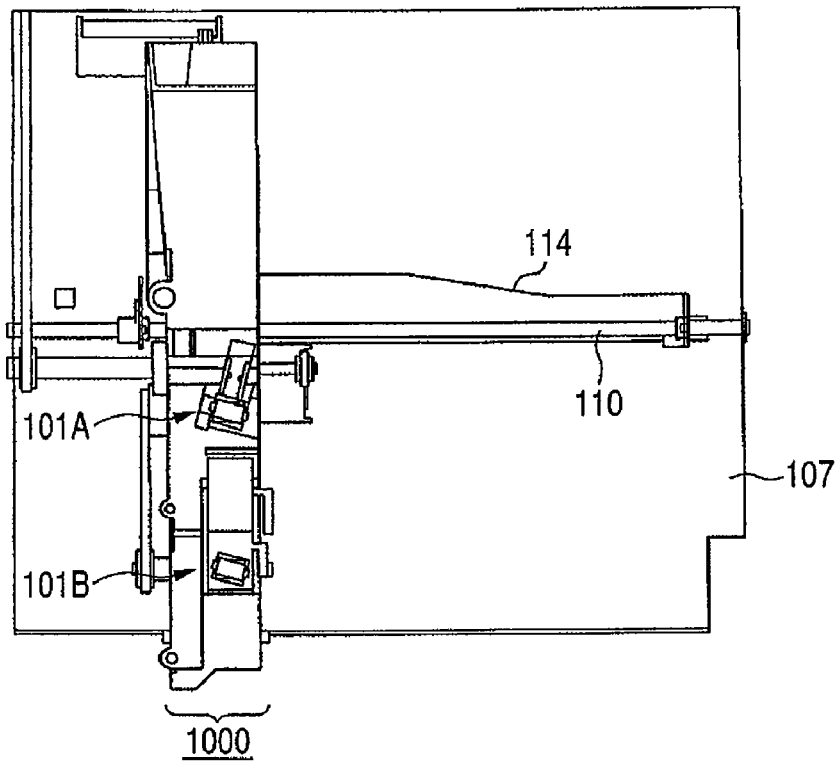
FIG. 6 is a top view illustrating the state where the lateral registration correcting unit has been moved.

FIG. 4 illustrates the state where the lateral registration correcting unit 1000 is located at a position corresponding to the sheet of the letter-legal size (hereinbelow, referred to as a letter-legal position). FIG. 6 illustrates the state where the lateral registration correcting unit 1000 is located at a position corresponding to the sheet of the A5 size (hereinbelow, referred to as an A5 position).

In the embodiment, the lateral registration correcting unit 1000 can move from the letter-legal position illustrated in FIG. 4 to the A5 position illustrated in FIG. 6 by a cam or a rack and pinion (not shown) as a moving unit. The embodiment will be described with respect to the sizes within a range from the A5 position to the letter position. However, in the case of coping with the sheet width the size which is equal to or less than A5 or the size which is equal to or larger than the letter-legal size, by widening the movable range in the width direction, the invention can easily cope with such sizes.

In the embodiment, the lateral registration correcting unit 1000 can move in the width direction while including the diagonal feed roller pairs 101A and 101B. The propagation of the driving to the diagonal feed roller pairs 101A and 101B which move together with the lateral registration correcting unit 1000 as mentioned above will now be described. A sheet re-feeding motor 12 (refer to FIG. 1) to drive the diagonal feed roller pairs 101A and 101B (diagonal feed rollers 101*a* and 101*b*) is provided in the duplex unit. First, the rotation of the sheet re-feeding motor 12 is propagated to the pulley 113*c* through a gear train (not shown) through the timing belt 106*b*.

A slide axis 115 is provided coaxially with the pulley 113*c*. The pulley 113*c* and the slide axis 115 are rotatably held to a bearing 116 provided for the bottom plate 107. A movable gear 114 is attached to the slide axis 115 so as to be slidable in the width direction.

The movable gear 114 is provided to rotate the pulley 113*b* having a gear portion (not shown). When the movable gear 114 rotates, the pulley 113*b* rotates. In association with the rotation of the pulley 113*b*, the diagonal feed roller 101*a* integratedly attached to the pulley 113*b* is driven.

The rotation of the pulley 113*b* is propagated to the pulley 113*a* through the timing belt 106*a*. When the driving is propagated to the pulley 113*a* in this manner, the diagonal feed roller 101*b* integratedly attached to the pulley 113*a* is rotated.

In the embodiment, the slide axis 115 and a through hole (not shown) of the movable gear 114 into which the slide axis 115 penetrates are formed in a D cross sectional shape. Thus, the slide axis 115 can propagate the rotation of the slide axis 115 to the movable gear 114 without obstructing the slide motion in the thrust direction of the movable gear 114.

When the lateral registration correcting unit 1000 moves from the letter-legal position to the A5 position, the movable gear 114 is pressed by a flange (not shown) provided for the pulley 113*b* and moved. On the contrary, when the lateral registration correcting unit 1000 moves from the A5 position to the letter-legal position, the movable gear 114 is pressed by the side wall of the reference member 100 and moved.

Since the movable gear 114 moves along the slide axis 115, even if the lateral registration correcting unit 1000 moves to the position corresponding to the sheet, the driving of the slide axis 115 can be propagated to the diagonal feed rollers 101*a* and 101*b* through the movable gear 114.

Figure 7:
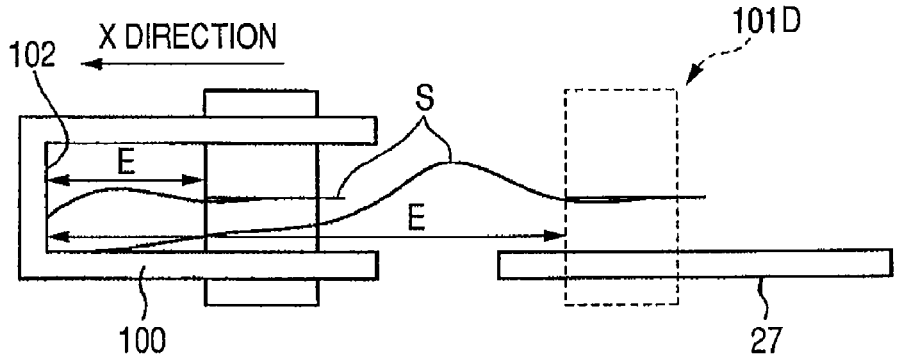
FIG. 7 is a diagram illustrating the state where a sheet is pressed onto a reference surface provided for the lateral registration correcting unit.

For example, when the reference surface 102 is fixed and the sheet is conveyed in a center reference manner, if a roller pair 101D is provided for the conveyance lower guide 27 as illustrated by a broken line in FIG. 7, a distance E to the reference surface 102 becomes long. When the distance E is long as mentioned above, for example, if the diagonal feed force is increased as mentioned above, a bending amount of the sheet increases, the position of the sheet width direction for the reference surface 102 is deviated, and the sheet is conveyed in this offset state.

However, by constructing in such a manner that the diagonal feed roller pairs 101A and 101B can be driven even if the lateral registration correcting unit 1000 moves in the width direction as mentioned in the embodiment, the lateral registration correcting unit 1000 can be moved according to the sheet size.

By moving the lateral registration correcting unit 1000 as mentioned above, the distance E from each of the diagonal feed roller pairs 101A and 101B to the reference surface 102, that is, the movement distance of the sheet can be shortened. Thus, since the sheet can be made to approach the reference surface 102 without increasing the diagonal feed force, the sheet bending amount decreases and the positional deviation in the sheet width direction for the reference surface 102 can be prevented.

By constructing in such a manner that the lateral registration correcting unit 1000 is moved in the width direction by the rack and pinion as already mentioned above, for example, the lateral registration correcting unit 1000 can be also positioned at a fine pitch such as about 1 mm.

Before the sheet reaches the lateral registration correcting unit 1000, the lateral registration correcting unit 1000 moves to a predetermined position according to a signal from a control unit (126) which is generated based on a signal from a detecting unit for detecting a length of sheet.

As such a detecting unit, there is a rear edge restricting unit (not shown) for restricting the sheet rear edge in the sheet feeding cassette 3*a* or a size detecting unit (not shown) for detecting the sheet size according to the sheet size position which is restricted by a side edge restricting unit for restricting the sheet side edge.

There are also a plurality of sheet width defecting flags which are arranged on the downstream side conveyance surface of the conveying roller pair 3*e* illustrated in FIG. 1 and detect the sheet width direction. Further, besides those sheet size detecting units, the sheet length can be also detected by a plurality of jam sensor flags or the like arranged in a conveying path of the laser beam printer 50.

The control unit drives the cam or the rack and pinion so as to move the lateral registration correcting unit 1000 to the position according to the sheet length based on the signals from those detecting units.

If the two or more diagonal feed roller pairs are provided as mentioned above, the rotation due to the conveyance resistance of the sheet S cannot be performed, so that the conveyance distance necessary to allow the sheet S to approach the reference surface 102 becomes long. For example, a deviation of the sheet S of about 2 to 3 mm from the reference surface 102 has to be presumed in consideration of a deviation amount of the sheet during the conveyance until the sheet reaches the lateral registration correcting unit 1000.

Since the sheet S of the legal size is heavy, the conveyance distance by the diagonal feed roller pairs 101A and 101B necessary to allow the sheet to approach by a length of the deviation of 1 mm in the width direction exceeds, for example, about 30 mm. For instance, in the case of the sheet of a short size that is equal to or shorter than an executive size, the sheet can be made to approach the reference surface 102 by a conveying path length of (executive size length)+(40 to 90 mm).

That is, even in the case where the two or more diagonal feed roller pairs are provided, so long as the sheet has the short size that is equal to or shorter than the executive size, if the conveyance distance obtained by subtracting the sheet length from a conveying path length L from the conveying roller 3*g* to the intermediate roller 3*d* is equal to 40 to 90 mm, the sheet can be made to approach the reference surface 102. In other words, so long as the sheet is the short size sheet, even if the two or more diagonal feed roller pairs are provided, the lateral registration correction of the sheet can be made without increasing the conveying path length.

Further, even if there are a plurality of diagonal feed roller pairs, when the contact pressures of the diagonal feed roller pairs at the positions other than one position serving as a rotational center of the sheet S are small and the rotation of the sheet S due to the conveyance resistance can be sufficiently performed, the rotation of the sheet S by the conveyance resistance as illustrated in FIGS. 10A, 10B, and 10C as mentioned above can be used.

Thus, the sheet S can be shifted from the state of FIG. 10A to the state of FIG. 10B, further, from the state of FIG. 10B to the state of FIG. 10C by the small conveyance distance and can be made to approach the reference surface 102. As a weight of the sheet like a sheet whose basis weight is large, a sheet of a large size such as a legal size, or the like is larger, the more the sheet can rotate easily.

Therefore, the embodiment is constructed in such a manner that when the lateral registration correcting unit 1000 is moved according to the sheet size (length in the sheet conveying direction), the contact pressures of the diagonal feed roller pairs are reduced or cancelled (the roller pairs are away from each other). Thus, even if the two or more diagonal feed roller pairs are provided, the lateral registration correction of the sheet can be made without increasing the conveying path length.

The construction for reducing or cancelling the contact pressures of the diagonal feed roller pairs according to the sheet size as mentioned above will now be described.

Figure 8:
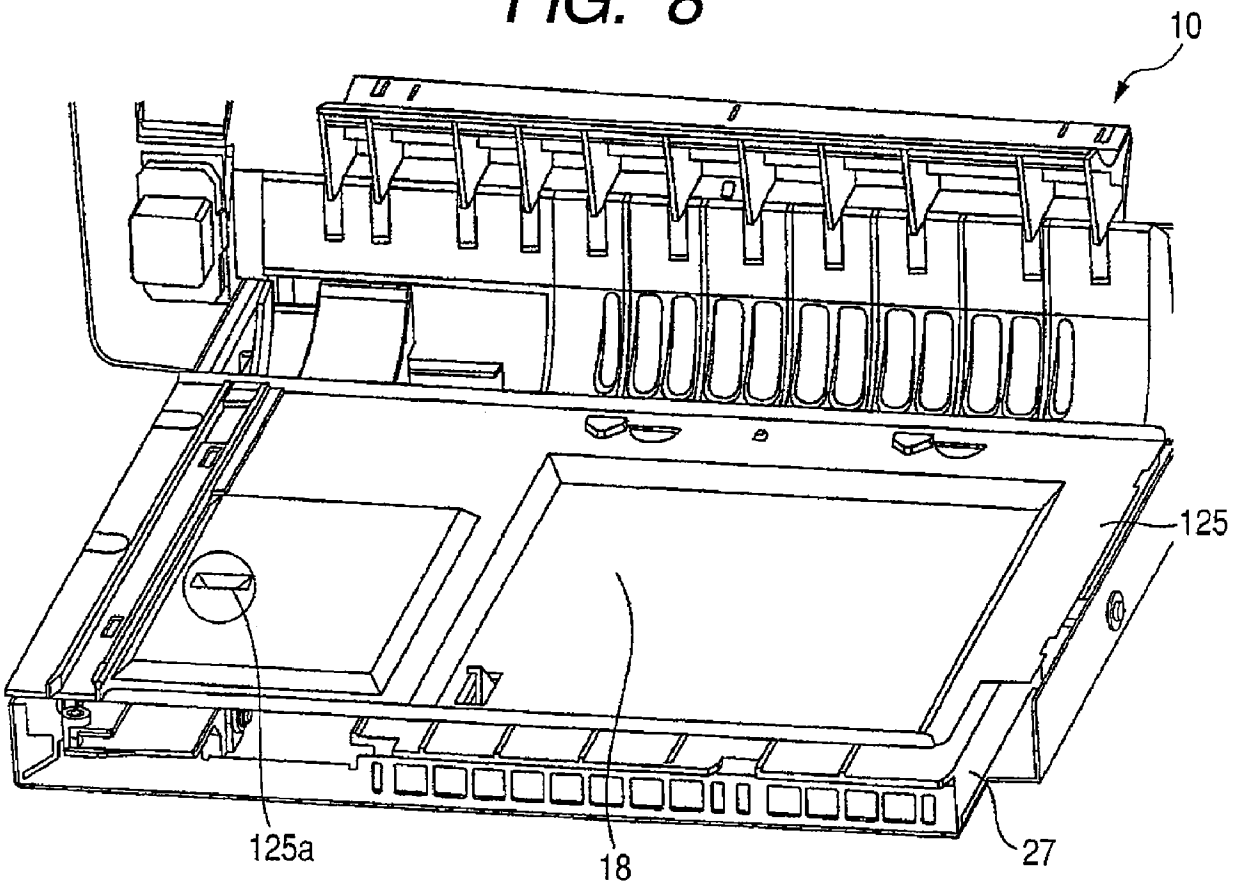
FIG. 8 is a perspective view of the duplex unit.

FIG. 8 is a perspective view of a conveyance upper guide 125 of the re-conveying path 18 provided for the duplex unit 10. As illustrated in FIG. 8, a rib 125*a* projecting in the direction of the foregoing diagonal feed roller holder 121 held to the reference member 100 illustrated in FIG. 3 so that it can swing freely is formed on the conveyance upper guide 125.

The rib 125*a* is constructed so as to press an N portion of the diagonal feed roller holder 121 illustrated in FIG. 3 when (the reference member 100 of) the lateral registration correcting unit 1000 moves from the foregoing A5 position illustrated in FIG. 6 to the letter-legal position illustrated in FIG.

4. By pressing the N portion of the diagonal feed roller holder 121 as mentioned above, the diagonal feed roller holder 121 swings in an F direction.

Figure 9A:
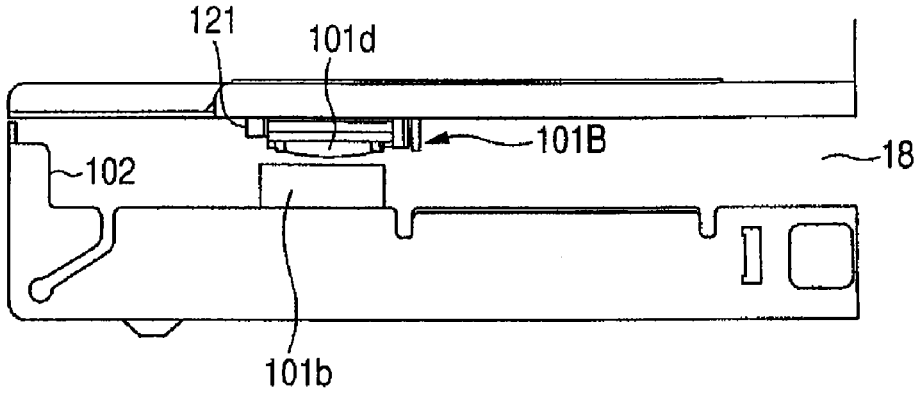
FIGS. 9A and 9B are schematic diagrams for describing the sandwiching state according to a sheet size of a diagonal feed roller pair provided for the duplex unit.

FIG. 9A illustrates the state where when the lateral registration correcting unit 1000 moves to the letter-legal position as mentioned above, the diagonal feed roller holder 121 pressed by the rib 125*a* has swung and moved to the position adapted to reduce or cancel (allow the roller pairs to be away from each other) (hereinbelow, referred to as a reducing/cancelling position). Since the diagonal feed roller holder 121 has swung and moved to the reducing/cancelling position as illustrated in the diagram, the diagonal feed rotation member 101*d* moves upward and the pressure contact with the diagonal feed roller 101*b* is cancelled.

Although the diagram illustrates the state where the pressure contact between the diagonal feed rotation member 101*d* and the diagonal feed roller 101*b* has been cancelled, the pressure contact between the diagonal feed rotation member 101*d* and the diagonal feed roller 101*b* can be also reduced by decreasing the upward movement amount of the diagonal feed rotation member 101*d*.

Figure 9B:
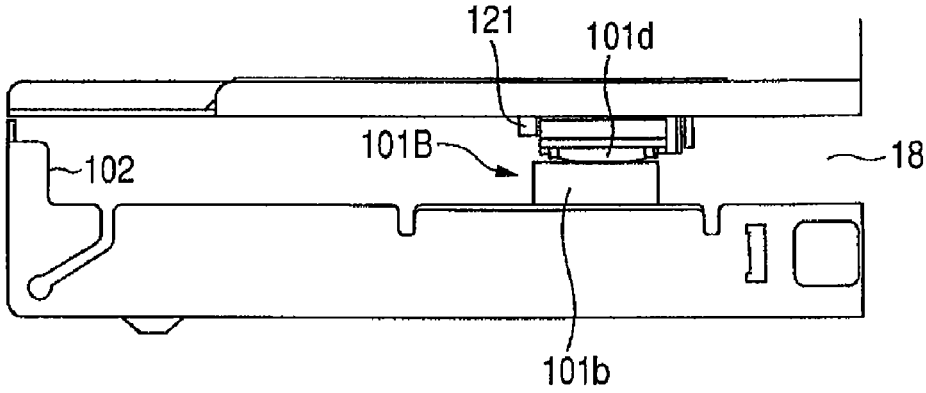

FIG. 9B illustrates the state where the lateral registration correcting unit 1000 has moved to the A5 position illustrated in FIG. 6 based on the size detection information. In this instance, since the N portion of the diagonal feed roller holder 121 is not pressed by the rib 125*a*, the diagonal feed roller holder 121 is located at the pressure contact position. Thus, the diagonal feed rotation member 101*d* is in pressure-contact with the diagonal feed roller 101*b* at a predetermined contact pressure.

That is, in the embodiment, the diagonal feed roller holder 121 which holds the diagonal feed rotation member 101*d* by the rib 125*a* as an interlocking member is moved to the pressure contact position or the reducing/cancelling position in an interlocking relational manner with the movement of the reference member 100 in the width direction. That is, in the embodiment, the reducing/cancelling unit for reducing or cancelling the contact pressure of the diagonal feed roller pair 101B in the two diagonal feed roller pairs 101A and 101B is constructed by the rib 125*a* and the diagonal feed roller holder 121.

As mentioned above, in the A4/letter-legal paper or custom paper according to such paper which needs the long conveyance distance for allowing the sheet to approach the reference surface 102, the diagonal feed roller holder 121 is swung, thereby cancelling (or reducing) the contact pressure of the diagonal feed roller pair 101B. Thus, even if there are a plurality of diagonal feed roller pairs, the sheet S can be rotated by the conveyance resistance of the conveyance lower guide 27. The conveyance distance for allowing the sheet to approach the reference surface 102 can be shortened.

As described above, according to the embodiment, the contact pressure with the diagonal feed rollers 101*b* and the diagonal rotation member 101*d* of the other diagonal feed roller pair 101B excluding the one diagonal feed roller pair 101A is reduced or cancelled according to the length of sheet in the sheet conveying direction. Therefore, the positioning in the width direction of the sheet can be certainly performed irrespective of the rigidity or size of the sheet.

Furthermore, by cancelling the contact pressure of the diagonal feed roller pair 101B in an interlocking relational manner with the movement of the lateral registration correcting unit 1000 in the width direction, the compact duplex unit 10 which can cope with various sheet sizes can be constructed by the small number of parts.

Although the embodiment has been described above with respect to the case of cancelling (or reducing) the contact pressure of the diagonal feed roller pair 111B in an interlocking relational manner with the movement of the lateral registration correcting unit 1000, the invention is not limited to such a construction.

For example, by providing a solenoid and a lever (not shown) as a reducing/cancelling unit for the lateral registration correcting unit, the contact pressure of the diagonal feed roller pair 101B can be independently cancelled (or reduced) based on the sheet size information irrespective of the movement of the lateral registration correcting unit 1000.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-086689, filed Mar. 27, 2006, which is hereby incorporated by reference herein in its entirety.

What is claimed is:

1. An image forming apparatus has an image forming unit configured to form an image on a sheet, the image forming apparatus comprising:

a conveying path configured to guide the sheet;

a reference surface, provided on the conveying path, to which a side edge of the sheet abuts; and a first diagonal feed unit and a second diagonal feed unit which diagonally convey the sheet so as to abut the side edge of the sheet to the reference surface for correcting the skew of sheet;

wherein the first diagonal feed unit and the second diagonal feed unit are arranged in a sheet conveying direction, and wherein, in a case in which a length of the sheet conveyed is longer than a predetermined length, a pressure of a nip portion of the second diagonal feed unit is reduced or canceled and the first diagonal feed unit diagonally conveys the sheet, and wherein the first diagonal feed unit conveys the sheet without reducing or cancelling a pressure of a nip portion thereof, regardless of the length of the sheet conveyed.

2. An apparatus according to claim 1, wherein the second feeding unit is provided on an downstream of the first diagonal feeding unit.

3. An apparatus according to claim 1, wherein the pressure of the nip portion of the second diagonal feed unit is canceled when the length of the sheet conveyed is longer than the predetermined length.

4. An apparatus according to claim 1, wherein the pressure of the nip portion of the second diagonal feed unit in a case in which the length of the sheet is longer than a predetermined length is set lower than the pressure of the nip portion of the second diagonal feed unit in a case in which the length of the sheet is shorter than the predetermined length.

5. An apparatus according to claim 1, wherein the second diagonal feed unit is constructed by a diagonal feed roller and a diagonal feed rotation member which comes into pressure-contact with and is away from the diagonal feed roller, the apparatus further comprising a controller which controls the position of the diagonal feed rotation member against the diagonal feed roller according to the length of the sheet so as to reduce or cancel the pressure of nip portion of the second diagonal feed unit.

6. An apparatus according to claim 1, further comprising:

a first conveying unit provided on an upstream side of the first diagonal feed unit and the second diagonal feed unit; and a second conveying unit provided on a downstream side of the first diagonal feed unit and the second diagonal feed unit;

wherein, in a case in which a length of the conveyed sheet in the sheet conveying direction is a length such that a front edge of the conveyed sheet reaches the second conveying unit before a skew of the conveyed sheet is corrected by the first diagonal feed unit and the second diagonal feed unit, the pressure of the nip portion of the second diagonal feed unit is reduced or canceled and the first diagonal feed unit diagonally conveys the sheet.

7. An apparatus according to claim 1, wherein the image forming unit forms the image on one side of the sheet, and then the sheet is conveyed again to the image forming unit through the conveying path.

* * * * *